US008844716B2

(12) United States Patent
Lee et al.

(10) Patent No.: US 8,844,716 B2
(45) Date of Patent: Sep. 30, 2014

(54) CAP ASSEMBLY HAVING STORAGE CHAMBER FOR SECONDARY MATERIAL WITH MOVABLE WORKING MEMBER

(71) Applicants: Jeong-Min Lee, Seoul (KR); Seong-Jae Lee, Seoul (KR)

(72) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 0 days.

(21) Appl. No.: 13/716,525

(22) Filed: Dec. 17, 2012

(65) Prior Publication Data

US 2013/0105339 A1 May 2, 2013

Related U.S. Application Data

(62) Division of application No. 12/595,551, filed as application No. PCT/KR2006/005425 on Dec. 13, 2006, now Pat. No. 8,336,706.

(30) Foreign Application Priority Data

| | | |
|---|---|---|
| Apr. 9, 2006 | (KR) | 10-2006-0032693 |
| May 1, 2006 | (KR) | 10-2006-0040370 |
| Jun. 10, 2006 | (KR) | 10-2006-0052836 |
| Oct. 25, 2006 | (KR) | 10-2006-0105538 |

(51) Int. Cl.
*B65D 25/08* (2006.01)
*B65D 51/28* (2006.01)

(52) U.S. Cl.
CPC ..... *B65D 25/08* (2013.01); *B65D 51/2864* (2013.01)
USPC ..... 206/221

(58) Field of Classification Search
CPC ..... B65D 25/08
USPC ..... 206/219–222, 568; 215/DIG. 8
See application file for complete search history.

(56) References Cited

U.S. PATENT DOCUMENTS

| | | | | |
|---|---|---|---|---|
| 937,049 A | | 10/1909 | Callahan | |
| 3,651,990 A | * | 3/1972 | Cernei | 206/221 |
| 4,591,050 A | | 5/1986 | Finke et al. | |
| 5,373,937 A | * | 12/1994 | Lamboy | 206/221 |

(Continued)

FOREIGN PATENT DOCUMENTS

| | | | |
|---|---|---|---|
| JP | 07-309376 | A | 11/1995 |
| JP | 2003002350 | A | 1/2003 |
| WO | 03059774 | A2 | 7/2003 |

OTHER PUBLICATIONS

Office Action for US U.S. Appl. No. 12/595,551, dated Apr. 23, 2012, 7 pages.

(Continued)

*Primary Examiner* — Luan K Bui
(74) *Attorney, Agent, or Firm* — Westman, Champlin & Koehler, P.A.

(57) ABSTRACT

A cap assembly having a storage chamber for a secondary ingredient, which is adapted to a mouth of a container, comprising: a body having a mouth; a chamber part having a storage space for secondary ingredient in the body and a hole formed at the lower end thereof; said chamber part is sealed by a movable working member and is opened when the movable working member is removed from the hole upon removing the cap so that the secondary ingredient may be mixed with the first ingredient in the container, said the movable working member being adapted to maintain the opened hole, after moving to open the hole, thereby effectively mixing of the different ingredients.

4 Claims, 8 Drawing Sheets

(56) References Cited

U.S. PATENT DOCUMENTS

| | | | | |
|---|---|---|---|---|
| 5,417,321 | A * | 5/1995 | Halm | 206/221 |
| 5,954,230 | A | 9/1999 | Blette et al. | |
| 6,045,254 | A * | 4/2000 | Inbar et al. | 206/222 |
| 6,148,996 | A * | 11/2000 | Morini | 206/222 |
| 6,840,373 | B2 | 1/2005 | Gibler et al. | |
| 7,588,142 | B1 * | 9/2009 | Bush | 206/221 |
| 8,556,103 | B2 * | 10/2013 | Tiesberger | 206/219 |
| 2004/0226835 | A1 * | 11/2004 | Takahashi et al. | 206/219 |
| 2005/0150902 | A1 | 7/2005 | Cho | |
| 2005/0211579 | A1 * | 9/2005 | Makita | 206/219 |

OTHER PUBLICATIONS

International Search Report for PCT Application PCT/KR2006/005425, filed Dec. 13, 2006; dated Apr. 13, 2007, 4 pages.

* cited by examiner

CAP ASSEMBLY HAVING STORAGE CHAMBER FOR SECONDARY MATERIAL WITH MOVABLE WORKING MEMBER

CROSS-REFERENCE TO RELATED APPLICATION

The present application is a Divisional of patent application U.S. Ser. No. 12/595,551, filed Oct. 12, 2009 which is a Section 371 National Stage Application of International patent application Serial No. PCT/KR2006/005425, filed Dec. 13, 2006, and published as WO 2007-117070 on Oct. 18, 2007, in English the content of which is hereby incorporated by reference in its entirety.

TECHNICAL FIELD

The present invention relates to a cap assembly for closing a container and more particularly to a cap assembly having a storage chamber for containing a secondary material for example a concentrated liquid or a granule different from a primary ingredient, for example water or a beverage accommodated in a container.

Such a cap assembly is useful in the various industrial fields such as medical, pharmaceutical, cosmetic and etc.

BACKGROUND ART

Generally, to mix a liquid in a container with a granule or a concentrate liquid as additives or secondary ingredients, it is often necessary that a separate chamber for storage the secondary ingredients is provided in the container.

There are many suggestions more than 5,000 including U.S. Pat. No. 937,049 (filed on Oct. 19, 1909) for the structure adapted to mix two or more different ingredients in a container.

However, the containers disclosed in the above patents have not commercially succeeded because of the problems such as inefficiency in a manufacture process, inconvenience in use, etc.

Particularly, there are further needs for more easily handling of a container and of a working means for mixing two or more ingredients in a container without problems of changing a structure or an injury of an elbow caused by acting an excessive force to open an discharging device.

Recently, PCT/EP2002/004523 filed on Jan. 17, 2002 and Japanese Patent Application No. 2001-00185428 filed on Jun. 19, 2001 suggested other structure, but a commercial success is not obtained.

Particularly, the structure disclosed in Japanese Patent Application mentioned above has a problem that a piece cut out from a discharging port fall into a container and a child may swallow it.

Other structure for separate storage of a secondary ingredient in a container also has a problem that the structure could not be adapted to a neck of a conventional bottle.

DISCLOSURE OF INVENTION

Technical Problem

In view of the above, an object of the present invention is to provide a cap assembly having an improved convenience with a mouth portion.

Another object of the present invention is to provide a cap assembly which is adapted to discharge a secondary ingredient into a container upon opening of a cap so that the secondary ingredient may be mixed with a primary ingredient in a container.

Another object of the present invention is to provide a cap assembly that upon opening of a cap, a secondary ingredient contained in a separate chamber may be quickly discharged into a container upon opening a cap and mixed with a primary ingredient.

Technical Solution

In order to accomplish the above-mentioned objects, a cap assembly according the present invention comprises a body adapted to be assembled to a mouth of a container and a chamber part separate from the body for containing a secondary ingredient in the body, which is adapted to a neck of a container, the chamber part selectively opened to discharge the secondary ingredient into the first ingredient in the container, thereby mixing together.

The cap assembly according to the present invention comprises a body having a mouth and assembled to the neck of the container; first and secondary movable working members assembled to the mouth and the secondary working member adapted to seal the chamber part.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Figure 1:
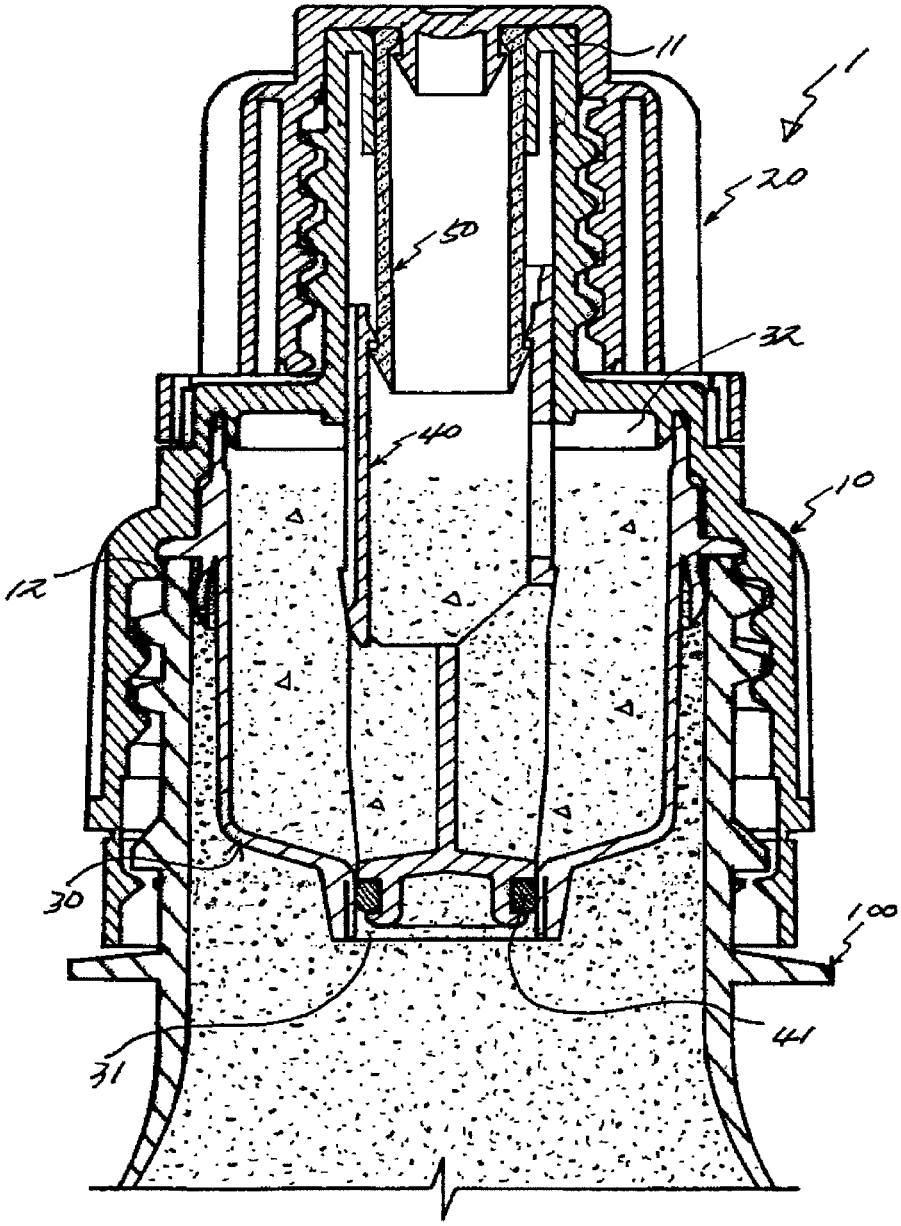
FIG. 1 is a longitude-sectional view of a cap assembly in accordance with a first embodiment of the present invention.

Reference will now be made to the drawings to describe the resent invention in detail. In the following description of the present invention, the same reference numerals are used for the same elements even in different drawings, and the duplicate explanation thereof will be omitted.

Referring to FIG. 1, a cap assembly 1 in accordance with the preferred embodiment of the present invention may be removably assembled at a container 100 for example a beverage container in such a way of a conventional thread engagement, snap-fit engagement or adhering types. The cap assembly 1 may be selectively removed from the container 100.

The cap assembly 1 comprises a body 10 which may be engaged with the neck of the container 100 and has an opened mouth 11 and an openable cap 20 provided at the mouth 11 of the body 10.

A chamber part 30 is assembled in the body 10 and a second working member 40 for openably sealing a hole 31 of the chamber part 30 is provided in the mouth 11 of the body 10 so as to be extended through the storage space 32.

A first working member 50 is assembled at the second working member 40 so that when use, the first working member 50 lifts up the second working member 40. The cap 20 is adapted to lift the first working member 50.

The chamber part 30 may be preferably filled with a secondary ingredient through the first working member 50, when the cap 20 is not assembled at the mouth 11.

The body 10 and mouth 11 may be assembled at the proper portion of the container 100 in a thread engagement or any other engagement type.

The cap 20 and skirt thereof may be formed in various shapes, for example to be inserted by a character.

The chamber part 30 is preferably made of a resin which is not deformed by a heat or pressure. A resilient annulus portion is formed at a flange of the chamber part 30 for sealing and it is preferred that the thickness of the annulus portion is possibly thin, but it should be enough to maintain the sealing property.

The body 10, in which the chamber part 30 is vertically assembled therein, is engaged with the container by rotation. For this purpose, a space is optionally be existed between the chamber part 30 and the engaging portion of the body 10 not to prevent rotation of the chamber part 30.

A sealing element 41 of silicon resin is preferably provided at the lower end of the second working member 40 plugging the hole 31 of the chamber part 30.

The first working member 50 is lifted for use of the cap assembly 1 and then the second working member 40 is not lowered at the mouth 11, although the cap 20 is plugged again.

When the cap 20 is opened in use, the first working member 50 is lifted, the second working member 40 is also lifted at the same time to open the hole 31, whereby the secondary ingredient in the storage space 32 falls down through the hole 31 and is mixed with the primary ingredient in the container 100.

When the cap 20 is plugged again at the mouth 11, the first working member 50 is lowered, but the second working member 40 is maintained at the lifted position so that the hole 31 is maintained in the opened status.

At this time, when the container 100 is shaken, the primary ingredient in the container 100 is moved into the storage space 32 and the remaining secondary ingredient is mixed with the first ingredient.

After the secondary ingredient in the chamber part 30 is mixed with the first ingredient, the cap 20 is removed and the mixtures of the first and secondary ingredients may be discharged through the first working member 50.

Figure 2:
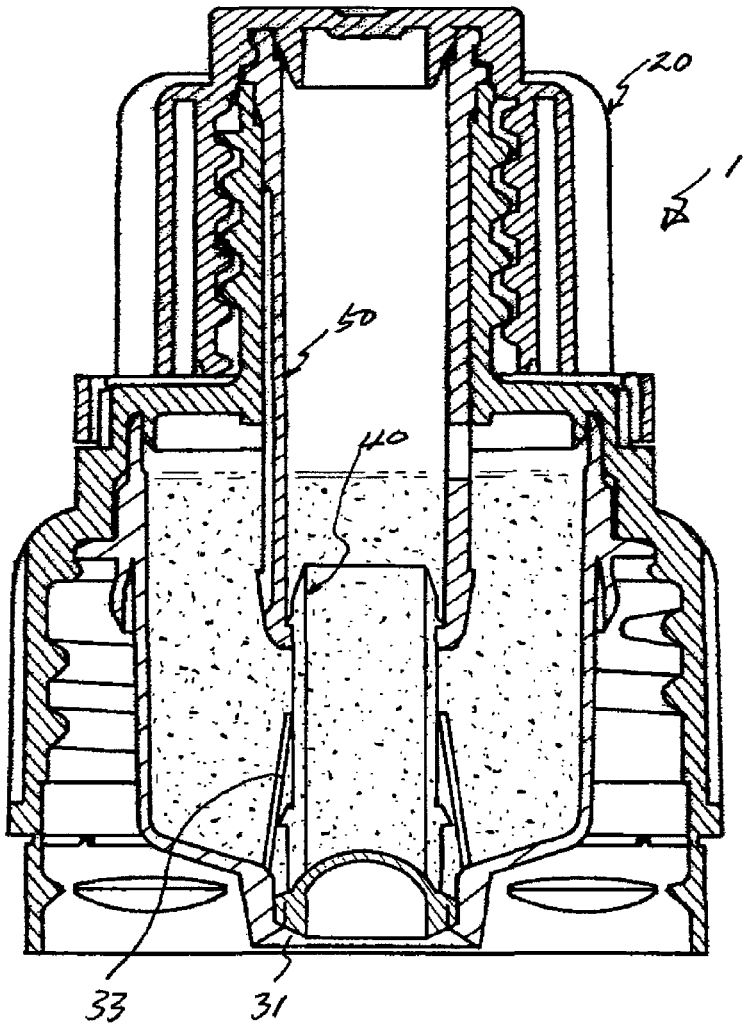
FIG. 2 is a longitude-sectional view of a cap assembly in accordance with a second embodiment of the present invention.

In the secondary embodiment shown in FIG. 2, this embodiment is different from the first embodiment in which the second working member 40 is prevented from lowering in the inner surface of the mouth 11 in that at least one resilient segment 33 formed at the chamber part 30 holds the second working member 40 in the lifted position.

Preferably, after the second working member 40 is lifted by the first working member 50, even though the first working member 50 is lowered, the resilient segment 33 abuts against the sealing surface to prevent the second working member from returning to the original position.

Figure 3:
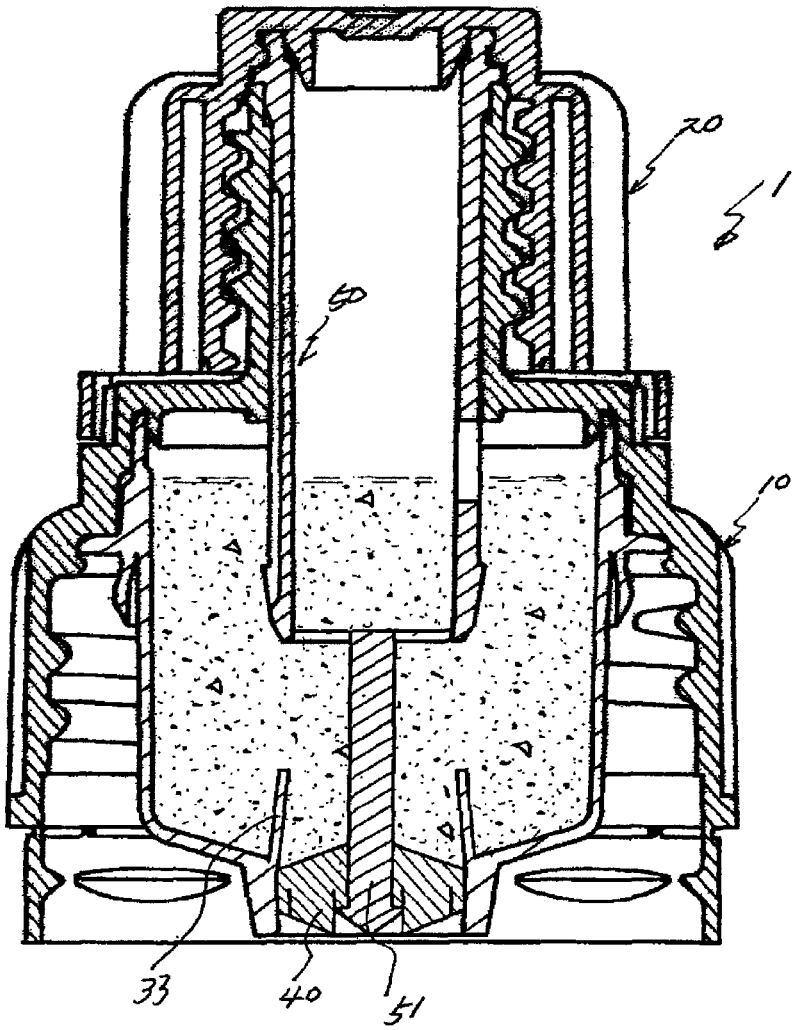
FIG. 3 is a longitude-sectional view of a cap assembly in accordance with a third embodiment of the present invention.

In the third embodiment shown in FIG. 3, the second working member 40 is connected to the connecting rod of the first working member 50, whereby the second working member 40 lifted by the first working member 50 in use is prevented form lowering by the resilient segment 33.

Figure 4:
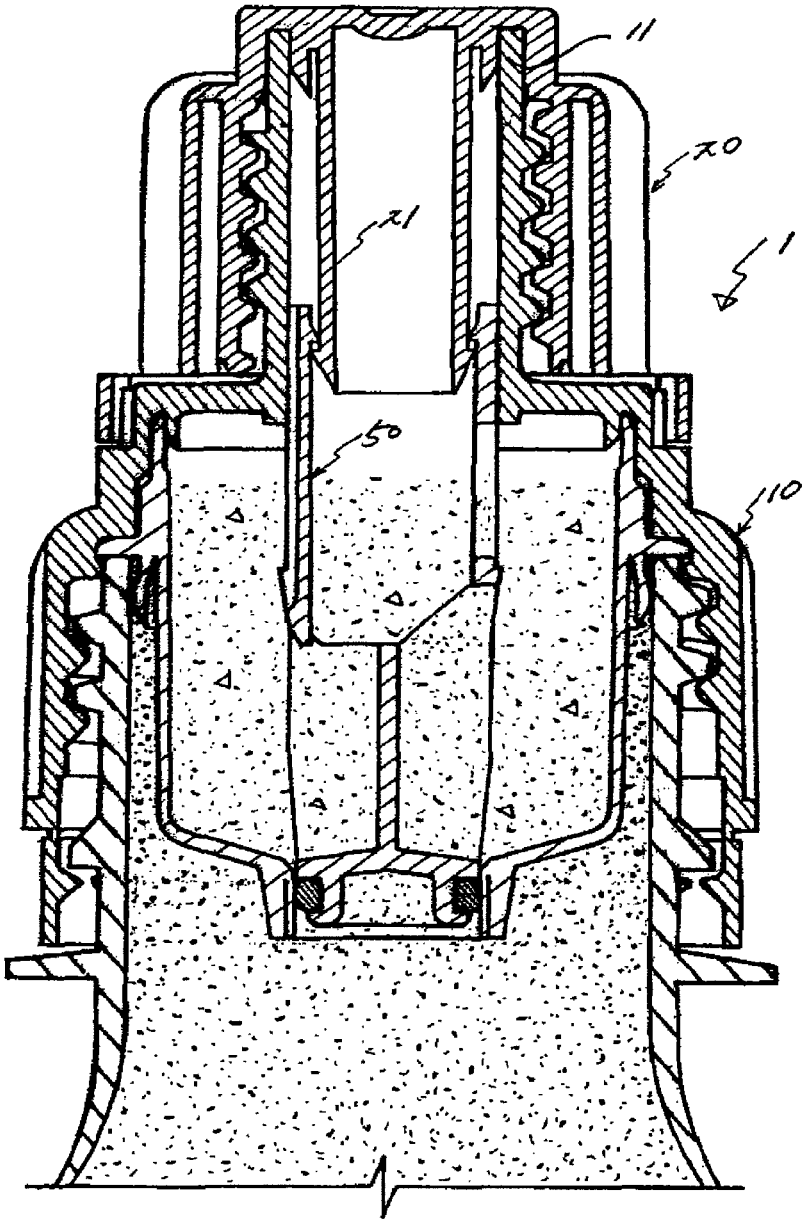
FIG. 4 is a longitude-sectional view of a cap assembly in accordance with a fourth embodiment of the present invention.

In the fourth embodiment shown in FIG. 4, while the first working member 50 in the previous embodiments is removed, an extension 21 downwardly formed at the cap 20 takes the place of the first working member 50.

When the cap 20 is lifted in use, the second working member 50 is lifted, but the second working member 50 is maintained in the lifted position even though the cap 20 is fitted again.

It is natural for user takes the mixtures removing the cap 20 from the second working member 50.

Figure 5:
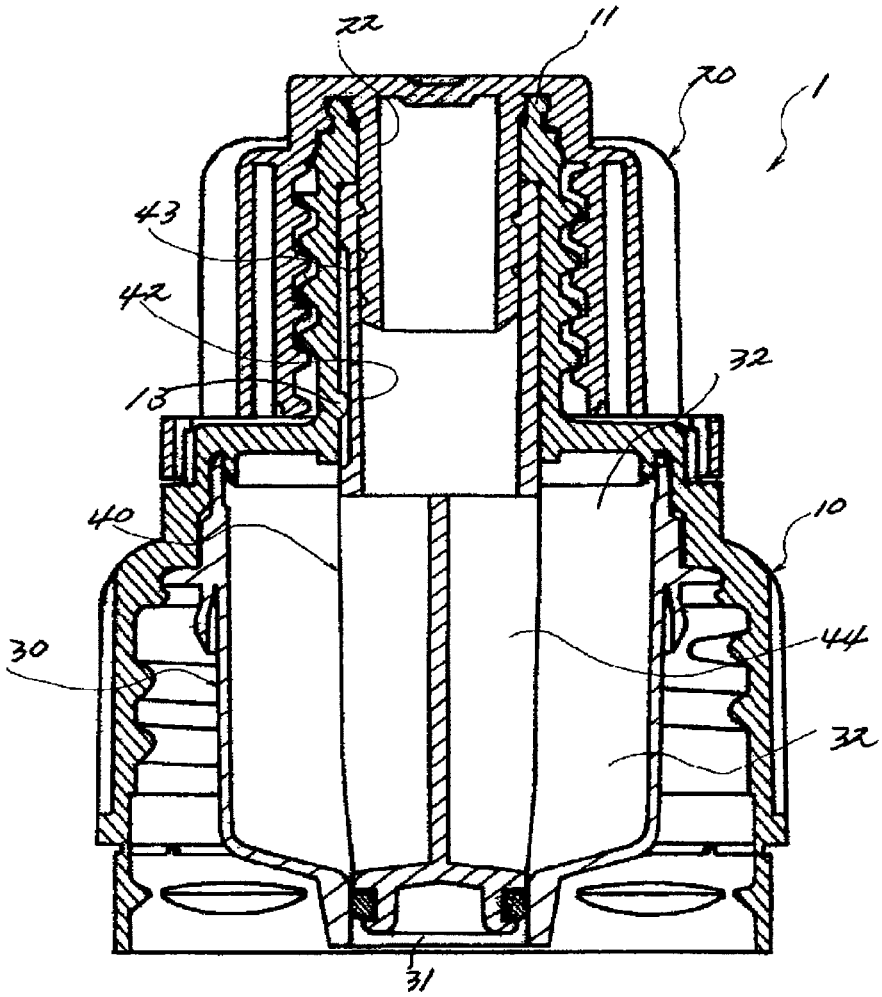
FIG. 5 is a longitude-sectional view of a cap assembly in accordance with a fifth embodiment of the present invention.
Figure 6:
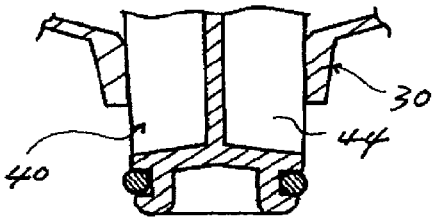
FIG. 6 is a longitude-sectional view of a part of the cap assembly of the FIG. 5 in use thereof.

In the fifth embodiment shown in FIGS. 5 and 6, the second working member 40 is adapted to be lowered at the inner surface of the mouth 11, thereby opening the hole 31.

Preferably, a long slot 43 is formed at the outside of the second working member 40 and a protrusion 13 formed at the inner surface of the mouth 11, so that the second working member 40 may be moved upwardly and downwardly without rotation. The shapes of the protrusion 13 and slot 43 may be changed in various forms.

The second working member 40 and the cap 20 are structured so that the second working member 40 may be lowered upon upward movement of the cap for opening the mouth.

That is, threads are formed at the inner surface of the second working member 40 and are correspondingly formed at a working element 22 downwardly formed at the cap 20.

When in use, the cap 20 is removed by rotation and then the second working member 40 is lowered to open the hole at the lower end of the chamber part 30(see FIG. 6), so that the secondary ingredient in the storage space 32 of the chamber part 30 falls into the container through the space 44.

Figure 7:
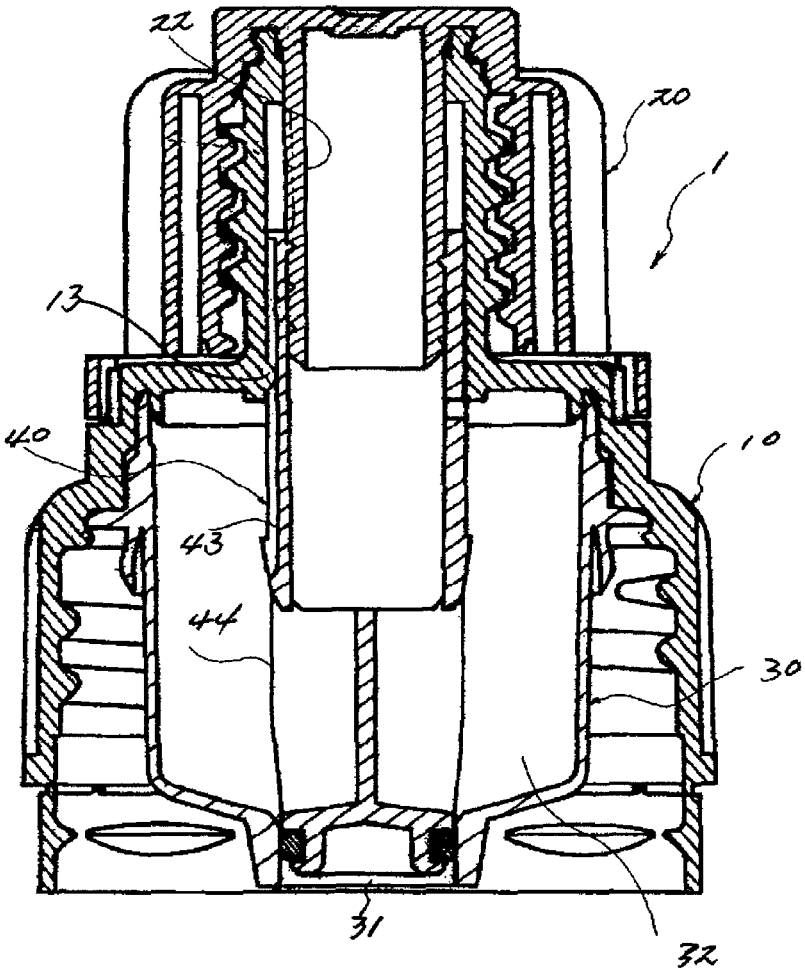
FIG. 7 is a longitude-sectional view of a cap assembly in accordance with a sixth embodiment of the present invention.
Figure 8:
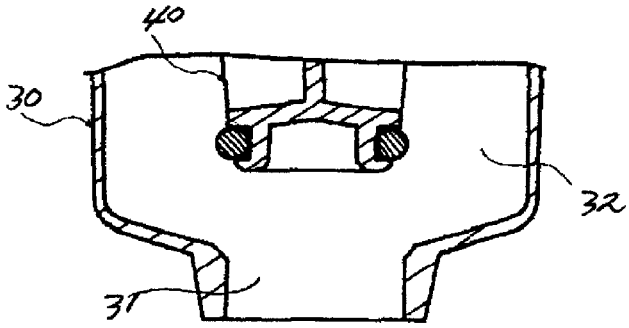
FIG. 8 is a longitude-sectional view of a part of the cap assembly of the FIG. 7 in use thereof.

In the sixth embodiment shown in FIGS. 7 and 8, this embodiment is structured to be reversely operated from the embodiment in FIG. 6.

That is, the second working member 40 is adapted to be lifted when the cap 20 is opened.

Figure 9:
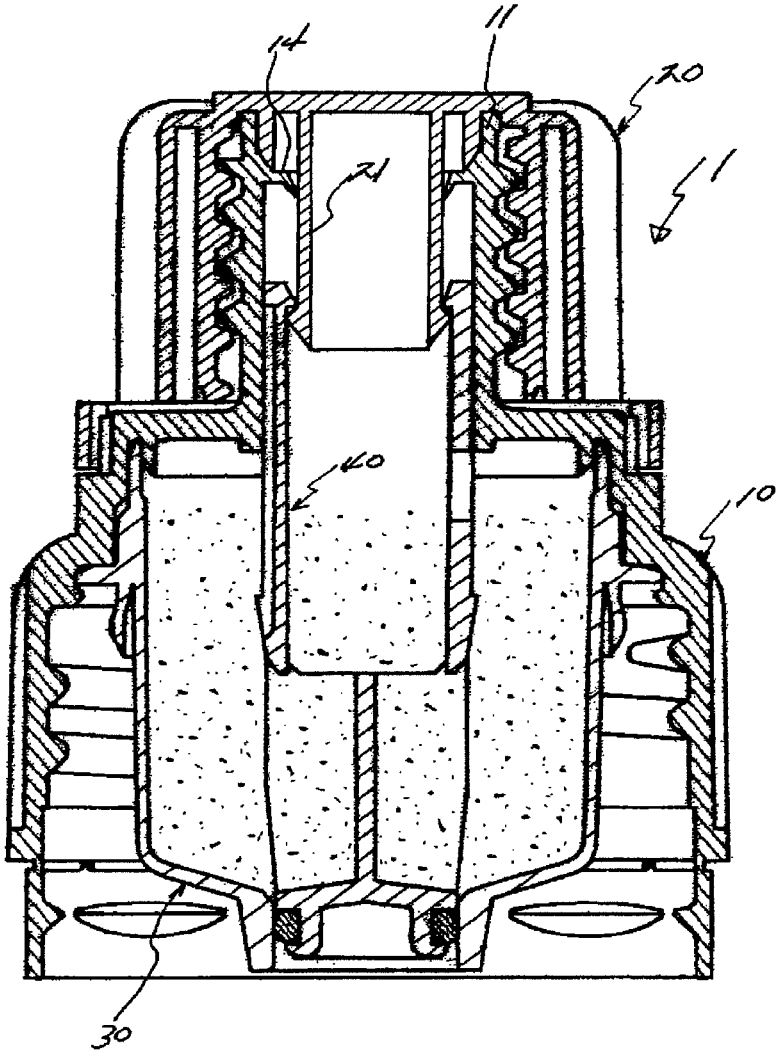
FIG. 9 is a longitude-sectional view of a cap assembly in accordance with a seventh embodiment of the present invention.
Figure 10:
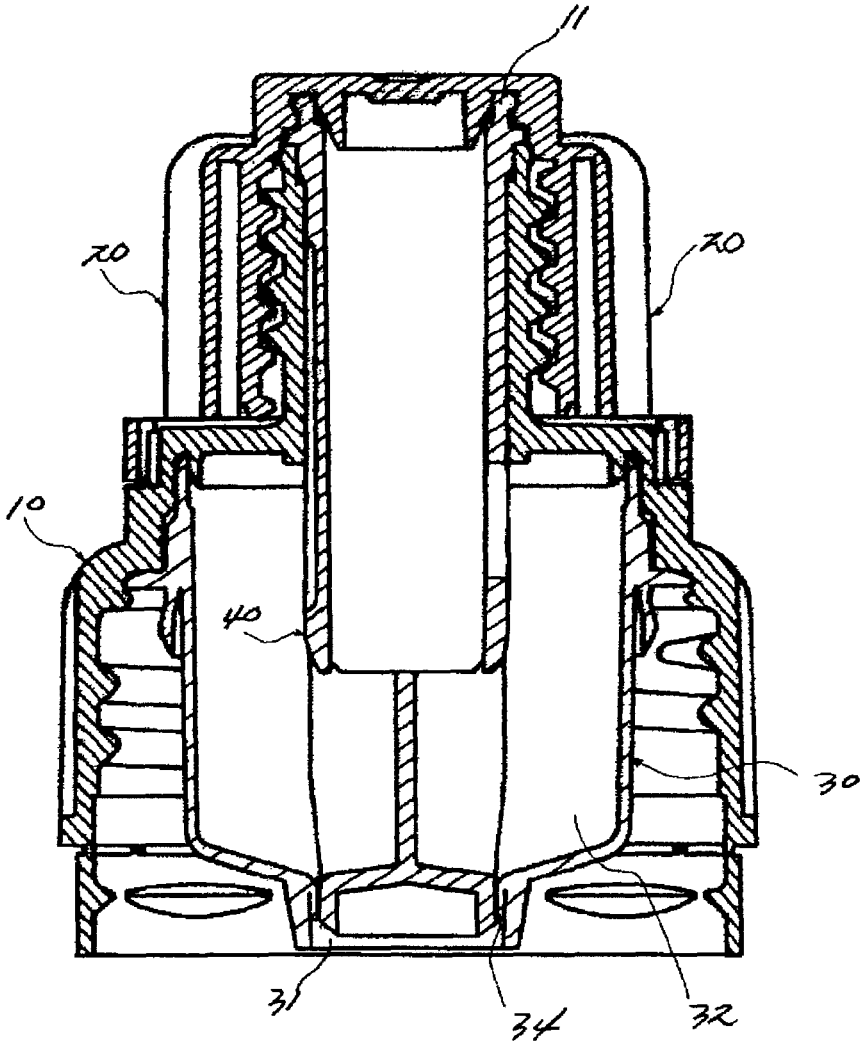
FIG. 10 is a longitude-sectional view of a cap assembly in accordance with a eighth embodiment of the present invention.
Figure 11:
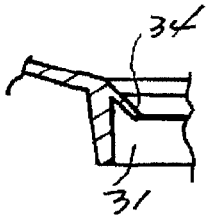
FIG. 11 is a longitude-sectional view of a part of the cap assembly of the FIG. 10 in use thereof.

In the seventh embodiment shown in FIG. 9, a stopper 14 is formed at the inner surface of the mouth 11 so that the second working member 40 may be lifted in a limited distance.

In the eighth embodiment shown in FIGS. 12 and 13, the second working member 40 may be removed together with the cap 20 and a resilient sealing member is formed at the hole 31.

INDUSTRIAL APPLICABILITY

As apparent from the above description, the cap assembly of the present invention may be adapted to accommodate a concentrated liquid or a granule to be mixed which a water, a beverage or other liquid in the container with an easy and improved mixing two different ingredients, which may be advantageous in the various industrial fields such as medical, pharmaceutical, cosmetic and etc.

Even when the cap removed is fitted at the mouth, the second working member is maintained at the opening position of the hole. At this time, by shaking the container, the primary ingredient in the container is moved into the storage space and the remaining secondary ingredient may be mixed with the first ingredient.

Therefore, user may have a good taste of the diluted beverage originally sought.

Furthermore, user may easily have the dilute beverage through the working member.

While the preferred embodiment in accordance with the present invention has been shown and described, equivalent modifications and changes known to persons skilled in the art according to the present invention are considered to be within the scope of the present invention as defined in the appended claims.

The invention claimed is:

1. A cap assembly engaged to a neck of a container, the cap assembly comprising:

a body having a mouth, a cap sealing the mouth, a first working member adapted to be lifted by the cap as the cap is lifted from the mouth, a second working member assembled to the first working member such that the second working member is lifted when the first working member is lifted, a chamber part having a storage space for an ingredient in the body, a hole formed at the lower end thereof, wherein:

before the cap is lifted, said hole is sealed by the second working member, when the cap is lifted thereby causing the first working member and the second working member to be lifted, the hole is opened, and when the first working member is lowered, the second working member is maintained at a lifted position so that the hole remains open.

2. The cap assembly in accordance with claim 1, wherein when said second working member is lifted the second working member is maintained in an inner surface of the mouth.

3. The cap assembly in accordance with claim 1, wherein the second working member is maintained in the lifted position by a resilient segment of the chamber part.

4. A cap assembly engaged on a neck of a container, the cap assembly comprising:

a cap;

a first working member connected to the cap;

a second working member connected to the first working member;

a chamber part having a storage space for storing an ingredient, a hole formed at the lower end thereof and a resilient member formed at the lower end thereof, and said hole being sealed by the second working member and opened when the cap is lifted causing the first working member and the second working member to be lifted wherein the resilient member maintains the second working member in a lifted position when the cap is lowered after being lifted.

* * * * *